US006767267B2

(12) United States Patent
Miller

(10) Patent No.: US 6,767,267 B2
(45) Date of Patent: Jul. 27, 2004

(54) APPARATUS TO BE WORN AS A NECKLACE AROUND THE NECK OF A SMALL CHILD, WHICH, WHEN SUBMERGED IN WATER, WILL INFLATE AN FLOAT THE CHILD'S HEAD ABOVE WATER

(76) Inventor: James Edgerly Miller, 372 W San Madele, Fresno, CA (US) 93704

( * ) Notice: Subject to any disclaimer, the term of this patent is extended or adjusted under 35 U.S.C. 154(b) by 0 days.

(21) Appl. No.: 10/445,764

(22) Filed: May 27, 2003

(65) Prior Publication Data

US 2003/0236040 A1 Dec. 25, 2003

Related U.S. Application Data

(60) Provisional application No. 60/384,273, filed on May 31, 2002.

(51) Int. Cl.[7] ..... B63C 9/08
(52) U.S. Cl. ..... 441/123; 441/98
(58) Field of Search ..... 441/98–101, 122, 441/123, 108

(56) References Cited

U.S. PATENT DOCUMENTS 1,400,976 A * 12/1921 Parmele ..... 441/123
1,442,746 A * 1/1923 Timberlake ..... 441/123
1,806,786 A * 5/1931 Claus ..... 441/101
2,742,654 A * 4/1956 Hurt ..... 441/118
4,297,758 A * 11/1981 Moran ..... 441/123

* cited by examiner

*Primary Examiner*—Ed Swinehart

(57) ABSTRACT

An apparatus to be worn as a necklace around the neck of a small child, which, when submerged in water, will inflate and float the child's head above water. The necklace will be composed of a gas generation chamber, two attached, inflatable balloons, a cosmetic sheath, or covering, and a small clasp to connect the necklace around the child's neck. When submerged in water a collapsible gas generation chamber, weighted on the bottom side, and an air bubble on the top side, will expand the gas generation chamber so that water is pulled, through a one-way valve, where it will start a reaction with anhydrous carbonate and acid, and from carbon dioxide gas. The gas will build pressure inside the chamber and push stoppers from the outlets into the balloons, and fill the deflated balloons, radially, away from the child's neck in order to float the child's head above the water.

14 Claims, 5 Drawing Sheets

SIDE

FRONT

SIDE

FRONT

APPARATUS TO BE WORN AS A NECKLACE AROUND THE NECK OF A SMALL CHILD, WHICH, WHEN SUBMERGED IN WATER, WILL INFLATE AN FLOAT THE CHILD'S HEAD ABOVE WATER

CROSS REFERENCE TO RELATED APPLICATIONS

This application is based on provisional application serial No. 60/384,273, filed on May 31, 2002.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of life saving floatation devices for children and more specifically to an apparatus to be worn as a necklace around the neck of a small child, which, when submerged in water, will inflate and float the child's head above water.

Annulus, life saving devices have been used for centuries. The earliest devices were hand held, and as technology improved, and materials became easier to use, the annulus ring around the neck began to appear in art. The first devices were placed around the neck and inflated as an adjunct to other life saving devices. Prior art also shows the annulus in the deflated position used by a swimmer, which, if he tires, he can blow through an attached straw-like tube, and inflate the annulus, before sinking after exhaustion. Prior art also uses compressed gas to inflate an annular ring around the neck with various trigger mechanisms to start the process, and many other devices which are triggered manually by the person wearing the device, before being subdued by the water. The more recent prior art uses chemical gas formation to inflate the life saving device, after triggered by the person wearing the device.

Earlier prior art is activated by the individual wearing the device. This presupposes the wearer of the device is aware of the dangers which may befall him, and will be able to react in a rational manner to save his own life. Much prior art also inflates inwardly and outwardly around the neck, and may create a hazzard of becoming too tight around the neck and occluding respiratory effort, or blood flow. Some prior art, which inflates automatically, uses compressed gas, and would seem to carry with it a hazzard of explosion when exposed to the heat of the sun for long periods. Concerned parents would not likely attach their children to such devices. There is also, in prior art, equipment that is worn when contact with water is probable, and the equipment is prophalactic in nature. This includes the life vest, the annulus ring thrown to drowning victims, and some devices worn around the neck when danger is anticipated.

None of the prior art addresses the problem which faces the small child who does not appreciate the dangers of water. Prior art is directed to the adult, who can control his fate by reacting to make the device helpful. The inflatable necklace is addressed to the small child who is caught without the ability to react, not understanding the danger of the water, and without adult supervision, drowns. The inflatable necklace works by use of a non toxic chemical reaction with water, and automatic inflation. The inflatable necklace inflates radially, and rapidly, away from the neck, thus creating no danger that the child will be chocked by the inflating necklace.

BRIEF SUMMARY OF THE INVENTION

The primary object of the invention is to provide a way to prevent a child from drowning when he accidently falls into a body of water without adult supervision, when he is in a place where he is not intended to be, without protective life saving equipment on, such as a floatation vest.

Another object of the invention is to provide a necklace, unrestrictive to child's play, cosmetic in appearance, that can be easily worn around the neck of the child all day long.

Another object of the invention is to provide a necklace that will inflate automatically when submerged in water, but if not submerged in water, will not inflate.

A further object of the invention is to provide a necklace that uses non toxic chemicals for gas formation, not compressed gas, which may be dangerous to the child.

Yet another object of the invention is to provide a necklace that inflates radially, away from the child's neck, to prevent pressure on the anatomy of the neck.

Still yet another object of the invention is to provide a necklace that inflates quickly when submerged in water, so that the child's head is not under water beyond the normal period which he will hold his breath.

Another object of the invention is to provide a necklace that will stay inflated and float the child for long periods of time.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus to be worn as a necklace around the neck of a small child, which, when submerged in water, will inflate and float the child's head above water, comprising: the necklace to be composed of a gas generation chamber, two attached, inflatable balloons, a cosmetic sheath, or covering, and a small clasp to connect the necklace around the child's neck, a collapsible gas generation chamber made of flexible plastic so that when the device is submerged the chamber will expand and draw water inside, mixing with chemicals, and forming a gas which will expand through openings at both sides of the chamber, and fill two adjacent balloons around a child's neck, and float his head above water.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

Figure 1:
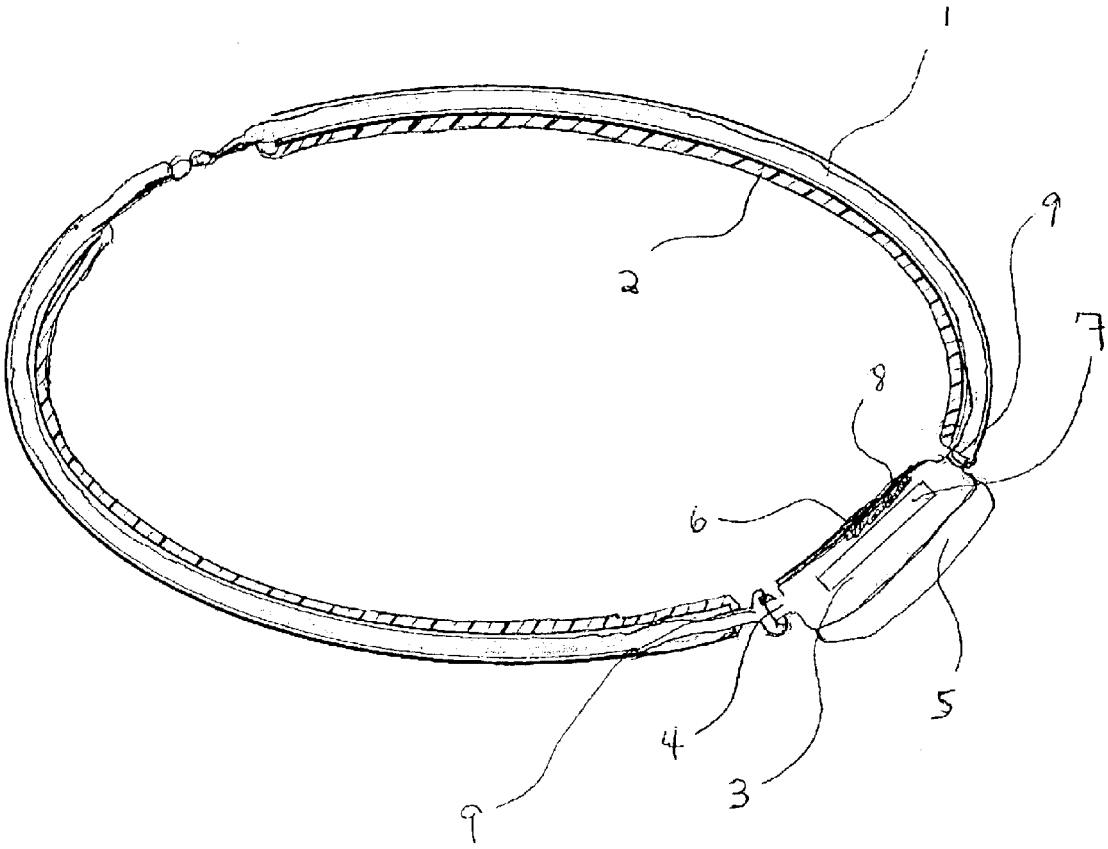
FIG. 1 is a cross sectional view of the necklace.

(1) Represents a cross sectional view of the two balloons inside the protective sheath (2) with a collapsible gas generation chamber made of flexible plastic (3) that attaches, on each side, to a balloon, which communicates with the chamber through 8 mm aperatures from the chamber to the balloon (4) so that when it is submerged in water the air bubble (5) pulls upward and the weighted lower part (6) pulls downward expanding the chamber which pulls water in through a one way valve, or flap, (7) filling the chamber and mixing with chemicals inside (8) rapidly forming carbon dioxide gas which builds pressure inside the chamber and pushes the stoppers out of the 8 mm outlets (9) into the balloons, and begins to inflate the balloons.

Figure 2:
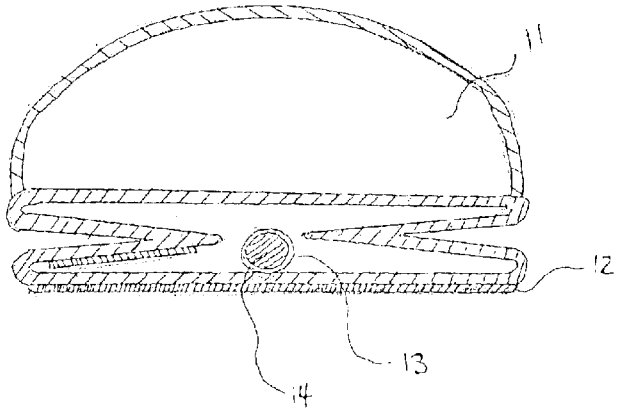
Figure 2:
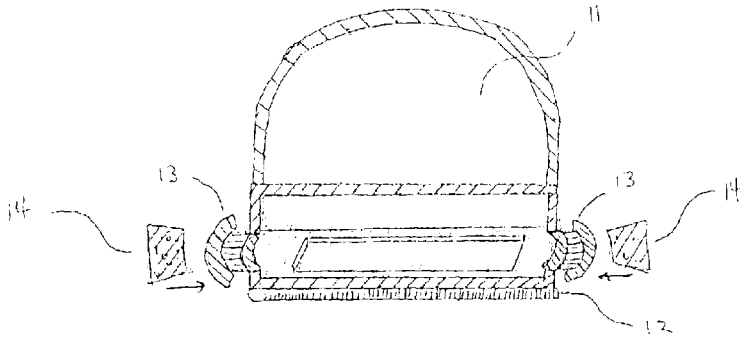

FIG. 2 is a cross sectional view of the collapsed gas generation chamber, prior to being submerged in water.

The air bubble (11) is attached to flexible plastic, or the top of the gas generation chamber, which, in the closed position, allows very little air to reside inside the chamber and prevents premature reaction with the chemicals, and the bottom of the chamber (12) is weighted with a material which readily sinks in water allowing the chamber to pull apart and expand when submerged. The 8 mm aperatures into the balloons from the gas generation chamber (13) contain stoppers (14) which maintain a closed chamber and make it easier for water to be pulled into the chamber, when the chamber is expanded.

Figure 3:
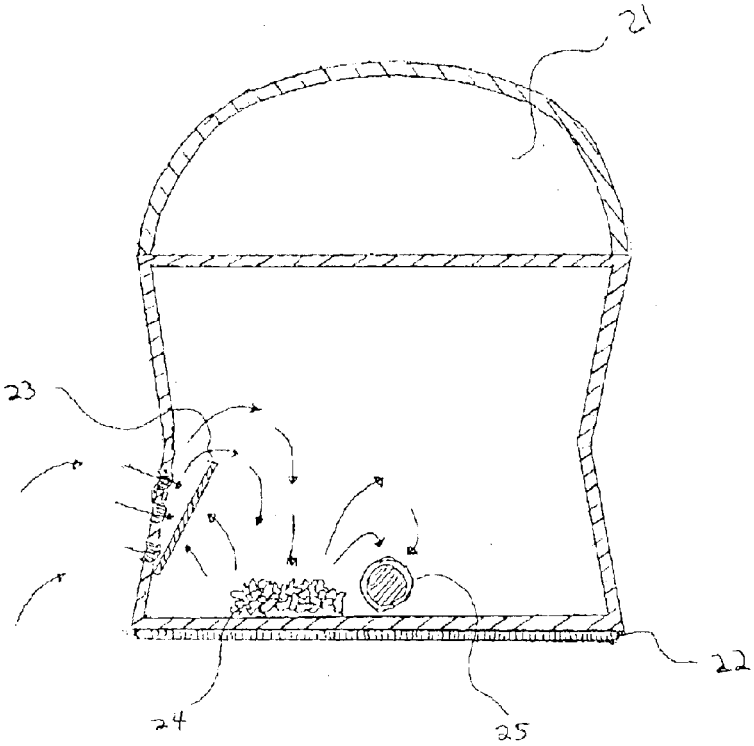
Figure 3:
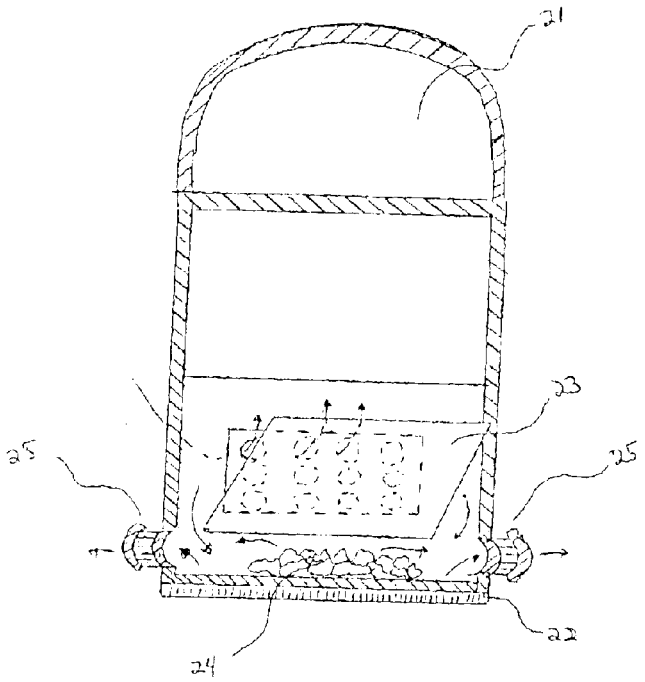

FIG. 3 is a cross sectional view of the expanded gas generation chamber.

When submerged in water the air bubble (21) is pulled away from the weighted bottom (22) thus expanding the chamber and drawing water in through the one way valve, or flap, (23) on the side of the chamber, which is not exposed in the collapsed condition, then when water mixes with the chemicals inside the chamber (24), carbon dioxide gas is formed and the resulting pressure pushes the stoppers out of the 8 mm aperatures (25) and into the balloons, the pressure of the gas sealing the water inlet valve (23) so that no gas can escape, and filling the balloons by the expanding gas through the outlets.

Figure 4:
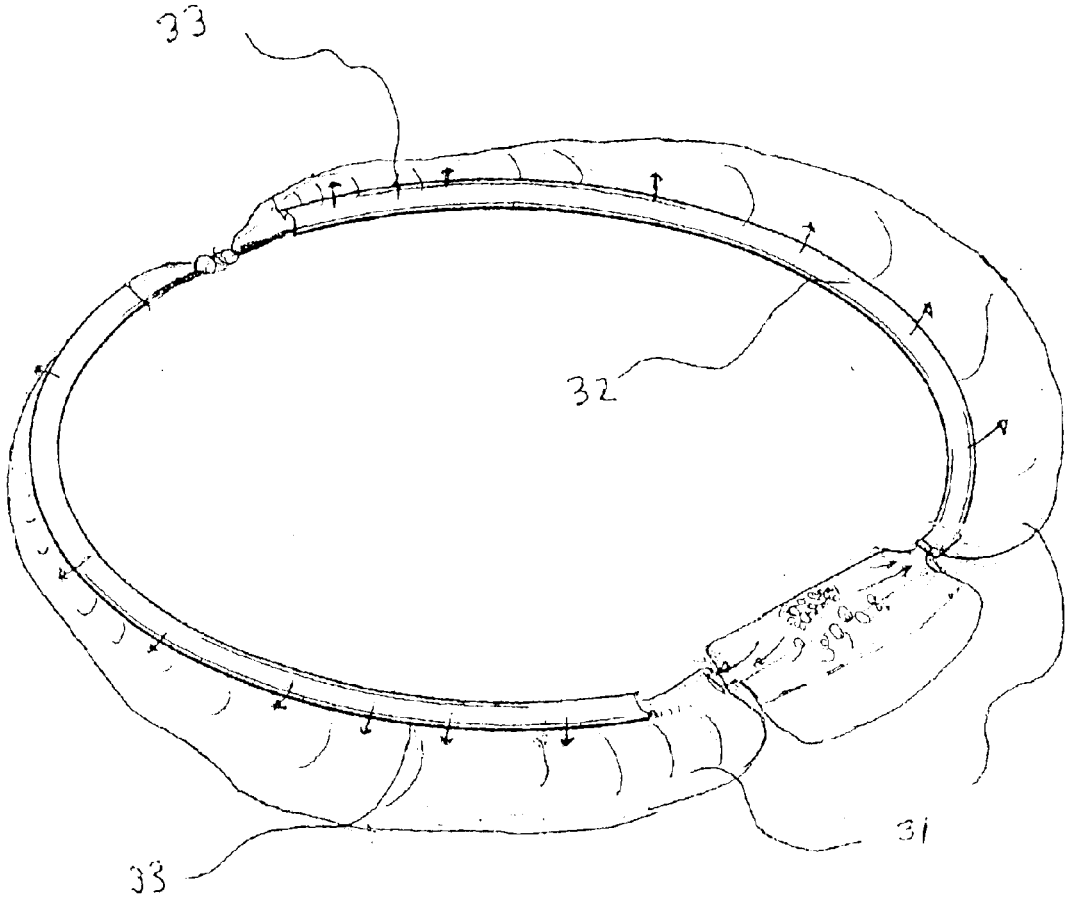

FIG. 4 is a perspective view of the balloons inflating radially, away from the neck.

As the balloons fill with carbon dioxide gas (31) they inflate radially from the annulus (32) through a slit in the protective sheath (33) thus, preventing any pressure against the child's neck.

Figure 5:
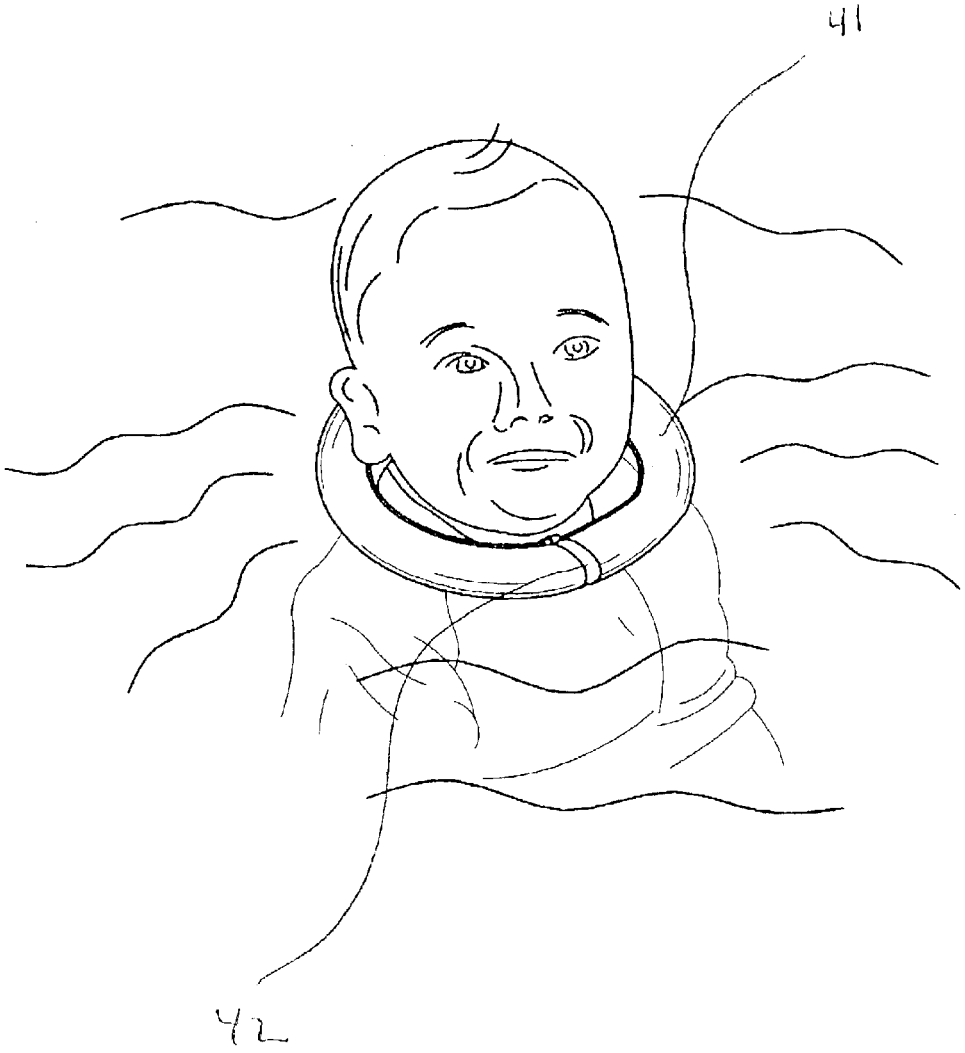

FIG. 5 is a perspective view of the child wearing the inflated necklace and floating with his head above the water.

The balloons (41) are inflated to form a floatation device, and the gas generation chamber (42) is inflated to add continuity to the floatation affect of the balloons.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

There are many floatation devices known in art. The most familiar of these is the life jacket, or life vest. These devices can be of the inflatable type or filled with a floatation material such as inclosed foam. Typically, these devices are worn wien danger is anticipated and keep the wearer's head above water. The vest can be adapted for pools, rivers, oceans, lakes, or any other dangerous body of water. One of the difficulties of the vest is that a small child cannot always be counted on to wear such a device, as it interfers with his ability to play. Another difficulty with the vest is that it is good when a dangerous body of water is anticipated, but not beneficial if not anticipated. The inflatable necklace is worn with comfort, and in times when danger is not anticipated.

Annulus rings are known in art. These can be shaped to fit around the waist, or, in some cases, around the neck and are most beneficial in keeping the person above water when water activity is planned. These devices are fabicated with a foam material, or an air resivoir, which is generally inflated by the wearer, or by someone else prior to entry into the water. They are beneficial only in anticipated danger situations and are not intended to for use on children, and specifically children who have wondered away from adult supervision, near a dangerous body of water. None inflate automatically when submerged, without the aid of the wearer. The inflatable necklace will inflate automatically when submerged and save the life of a child that is caught unaware.

There are also known in art, devices referred to as slings. These devices fit around the shoulders and waist and are used as swimming augmentation devices. This appliance is useful when swimming long distance, but is of little value for supporting the head above water, and must be donned and fully inflated prior to entry into the water.

Also known in art are air filled devices, which fit around the bicep of a child and keep the wearer afloat while in the water. These devices, as with the vest, and the annulus ring, are most beneficial while adult supervision is present, and the child is deliberately near a dangerous body of water. They are not intended for normal play away from the water and will not be worn in those dangerous situations when there is no adult supervision, and when contact with water is not anticipated. The inflatable necklace will be worn in these awkard times, when water is not anticipated, or expected.

Also known in art are devices that use compressed gas to inlate a necklace, or vest, worn by a swimmer. Most of these devices are self activated when danger is anticipated, or the swimmer is too tired to complete a swim and is in danger of drowning. Some are activated by pulling or pushing on a device while in the water, and either inflating the device with compressed gas, or with chemical gas. The inflatable necklace inflates automatically when submerged and avoids the dangers of compressed gas.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus to be worn as a necklace around the neck of a small child, which, when submerged in water, will inflate and float the child's head above water comprising:

a necklace with a gas generation chamber, two attached, inflatable balloons, a cosmetic sheath, or covering, and a small clasp to connect the necklace around the child's neck;

a collapsible gas generation chamber made of flexible plastic with a volume of 20 cubic centimeters which will expand under water, draw water into the chamber where it will mix with chemicals form carbon dioxide gas and inflate the balloons radially around the neck, and float the child's head above the water.

2. The apparatus recited in claim 1 wherein, the collapsible gas generation chamber will be weighted on the bottom side, and will contain an air bubble on the top side, so that when the device is submerged the air bubble will pull the top of the chamber upward, and the weighted portion will pull the bottom of the chamber downward, thus expanding the chamber.

3. The apparatus recited in claim 1 wherein, the expansion of the chamber will draw water into the gas generation chamber wherein it will mix with anhydrous carbonate and acid, in combination with a catalyst, to rapidly form carbon dioxide gas.

4. The apparatus recited in claim 1 wherein, the collapsible gas generation chamber will have two circular outlets, measuring 8 mm in diameter, which will be sealed with removable stoppers to maintain an air seal to the gas generation chamber.

5. The apparatus recited in claim 1 wherein, as the gas begins to form, the inlet water valve is sealed by the said gas pressure and the plugged outlet aperatures are opened by the same pressure and the carbon dioxide gas fills the two inflatable balloons.

6. The apparatus recited in claim 1 wherein, the collapsible gas generation chamber will have a valve, or flap, which will open inwardly to allow water to enter when the chamber is expanded, but prevent gas from escaping through that same valve as the gas begins to form.

7. The apparatus recited in claim 1 wherein, the collapsible gas generation chamber will expand with the production of carbon dioxide gas, filling the two attached balloons, and, itself, serving as a third balloon.

8. The apparatus recited in claim 1 wherein, the collapsible gas generation chamber will have an inflatable balloon attached to each side of the chamber.

9. The apparatus recited in claim 1 wherein, the balloons will be crescent shaped, will each hold 350 cubic centimeters of gas when inflated, and connect under the chin of the child.

10. The apparatus recited in claim 1 wherein, the balloons will be constructed of a durable, but thin, flexible plastic and have a thickened portion of plastic where they attach to each other under the chin of the child.

11. The apparatus recited in claim 1 wherein, the balloons will be contained inside a cosmetic plastic sheath, which has an opening, or slit, facing outward along the annulus, and the balloon will easily escape outward away from the child's neck through the opening when inflating.

12. The apparatus recited in claim 1 wherein, the necklace will have a clasp to attach the balloons together around the child's neck and, thus completing the necklace.

13. The apparatus recited in claim 1 wherein, the necklace will be adjustable to plus or minus ½ inch, from 11½ inches in circumfrence.

14. The apparatus recited in claim 1 wherein, the necklace, when inflated, will float a small child's head above water for sufficient time for an adult to find the child and save the child from drowning.

* * * * *